US009453621B2

(12) United States Patent
Ohno

(10) Patent No.: US 9,453,621 B2
(45) Date of Patent: Sep. 27, 2016

(54) ILLUMINATION APPARATUS HAVING INTERCONNECTABLE LIGHT EMITTING PARTS

(71) Applicant: MINEBEA CO., LTD., Kitasaku-Gun, Nagano (JP)

(72) Inventor: Yasuo Ohno, Iwata (JP)

(73) Assignee: Minebea Co., Ltd., Nagano (JP)

( * ) Notice: Subject to any disclaimer, the term of this patent is extended or adjusted under 35 U.S.C. 154(b) by 77 days.

(21) Appl. No.: 14/477,927

(22) Filed: Sep. 5, 2014

(65) Prior Publication Data

US 2015/0070882 A1 Mar. 12, 2015

(30) Foreign Application Priority Data

Sep. 12, 2013 (JP) ..... 2013-189514

(51) Int. Cl.
*F21K 99/00* (2016.01)
*F21V 21/005* (2006.01)
*F21Y 103/00* (2016.01)

(52) U.S. Cl.
CPC .. *F21K 9/30* (2013.01); *F21S 4/28* (2016.01); *F21V 21/005* (2013.01); *F21Y 2103/003* (2013.01)

(58) Field of Classification Search
CPC ..... F21K 9/30; F21V 21/005; F21S 4/008
See application file for complete search history.

(56) References Cited

FOREIGN PATENT DOCUMENTS

JP 2009-099363 A 5/2009

*Primary Examiner* — Joseph L Williams
(74) *Attorney, Agent, or Firm* — Carrier Blackman & Associates, P.C.; Joseph P. Carrier; Jeffrey T. Gedeon

(57) ABSTRACT

An illumination apparatus includes a plurality of light emitting parts, and a connection part linearly connecting the plurality of light emitting parts. Each light emitting part includes a light emission surface configured to emit light, and an attachment surface facing the light emission surface in a thickness direction of the light emitting part. The connection part includes a first connector fixed to one end of one of the light emitting parts in a longitudinal direction thereof, a second connector fixed to the other end of an adjacent one of the light emitting parts and connected to the first connector of the one of the light emitting parts, and a mechanical connection part and an electric connection part of mechanically and electrically connecting the first connector and the second connector by relatively moving the first connector and the second connector in the thickness direction of the light emitting part.

8 Claims, 4 Drawing Sheets

ILLUMINATION APPARATUS HAVING INTERCONNECTABLE LIGHT EMITTING PARTS

CROSS-REFERENCE TO RELATED APPLICATION

This application claims priority from Japanese Patent Application No. 2013-189514, filed on Sep. 12, 2013, the entire subject matter of which is incorporated herein by reference.

BACKGROUND OF THE INVENTION

1. Field of the Invention

The present invention relates to an illumination apparatus, and more particularly, to a long illumination apparatus used for a store shelf and the like.

2. Description of Related Art

In recent years, a light emitting diode (LED) with lower power consumption has been used as a light source for a long illumination apparatus (a so-called under shelf illumination apparatus) for illuminating a showcase or shelf in a store. In this long illumination apparatus using the LED as the light source, there has been suggested a technique in which a plurality of units divided in a longitudinal direction are connected to configure an integral long illumination apparatus (for example, refer to JP-A-2009-99363). By employing this long illumination apparatus for the under shelf illumination apparatus, operability of attaching the illumination apparatus to the shelf and the like is improved, and it is possible to flexibly adjust a length of the illumination apparatus according to a length of the shelf.

Specifically, FIG. 5 shows the illumination apparatus disclosed in JP-A-2009-99363. The illumination apparatus 100 shown in FIG. 5 includes a plurality of illumination units 111 each of which has a base 102A and a plurality of LEDs 103 arranged on an upper surface 102*a* of the base 102A. Each illumination unit 111 has a male connector 104A at one end in a longitudinal direction and a female connector 105A at the other end. The plurality of illumination units 111 are electrically connected and are coupled in the longitudinal direction by connecting the male connectors 104A and the female connectors 105A of the adjacent illumination units 111.

SUMMARY

However, in this illumination apparatus 100, a direction along which the respective illumination units 111 are connected (coupled) is the longitudinal direction of the illumination apparatus 100. Therefore, when an operation for attaching the illumination apparatus 100 to an attachment body such as the store shelf is performed for each illumination unit 111, operability (particularly, operability of attaching the illumination unit 111 to be attached at the end) is deteriorated. Further, when one illumination unit 111 is broken after attaching the illumination apparatus 100, it is not easy to detach only the broken illumination unit 111.

Accordingly, it is an object of the present invention to provide an illumination apparatus which can be elongated by connecting a plurality of illumination units and enables each illumination unit to be easily attached and replaced.

The following aspects of the present invention are illustrative of the configuration of the present invention, and will be described in respective sections to facilitate the understanding of the various configurations of the present invention. Each section is not intended to limit the scope of the present invention, but while taking into consideration illustrative embodiments of the present invention, replacement, or deletion of a part of the components described in each section, or addition of other components thereto may be included in the technical scope of the present invention.

(1) An illumination apparatus comprises a plurality of light emitting parts, and a connection part linearly connecting the plurality of light emitting parts. Each of the light emitting parts includes a light emission surface configured to emit light, and an attachment surface facing the light emission surface in a thickness direction of the light emitting part. The connection part includes a first connector fixed to one end of one of the light emitting parts in a longitudinal direction thereof, a second connector fixed to the other end of an adjacent one of the light emitting parts in the longitudinal direction and connected to the first connector of the one of the light emitting parts, and a mechanical connection part and an electric connection part of mechanically and electrically connecting the first connector of the one of the light emitting parts and the second connector of the adjacent one of the light emitting parts by relatively moving the first connector and the second connector in the thickness direction of the light emitting part.

According to the above configuration, a plurality of illumination units each of which includes the first connector fixed to one end of the light emitting part in the longitudinal direction and the second connector fixed to the other end of the light emitting part in the longitudinal direction are provided, and the plurality of illumination units are connected in the longitudinal direction of the light emitting part through the connection part to configure the long illumination apparatus. The illumination apparatus can be attached to an attachment body while attaching each illumination unit to the attachment body.

Further, according to the above configuration, the connection part has the mechanical connection part and the electric connection part of mechanically and electrically connecting the first connector and the second connector by relatively moving the first connector and the second connector in the thickness direction of the light emitting part. Accordingly, it is possible to easily attach the illumination unit to the attachment body while connecting the illumination unit to the illumination unit already attached, thereby improving the operability of the operation of mounting the illumination apparatus. Also, it is possible to easily detach a specific illumination unit without influencing an attached state of the other illumination unit already attached to the attachment body, and to replace the specific illumination unit with a new illumination unit, as required, so that it is possible to improve the operability of detaching and replacing the illumination unit.

(2) In the illumination apparatus of (1), the mechanical connection part may have a concave-convex structure extending in the thickness direction of the light emitting part, and in the concave-convex structure, a structure of the first connector and a structure of the second connector may be complementary to each other.

According to the above configuration, it is possible to easily configure the mechanical connection part at low cost, which mechanically connects the first connector and the second connector by relatively moving the first connector and the second connector in the thickness direction of the light emitting part.

(3) In the illumination apparatus of (1) or (2), the electric connection part may include a conductor pattern provided on the first connector, and a spring-type terminal provided on the second connector and configured to contact the conductor pattern, and the conductor pattern and the spring-type terminal may be provided to extend in the thickness direction of the light emitting part.

According to the above configuration, it is possible to easily configure the electric connection part at low cost, which electrically connects the first connector and the second connector by relatively moving the first connector and the second connector in the thickness direction of the light emitting part.

(4) In the illumination apparatus of (3), the concave-convex structure may be formed along the longitudinal direction of the light emitting part and may be provided at a plurality of positions in a direction perpendicular to the longitudinal direction and the thickness direction of the light emitting part.

According to the above configuration, the relative movement between the first connector and the second connector of the connection part in the longitudinal direction of the light emitting part and in the direction perpendicular to the longitudinal and thickness directions of the light emitting part is effectively restrained, so that it is possible to stably keep the mechanical connection between the first connector and the second connector.

(5) In the illumination apparatus of (4), the concave-convex structure may be provided at both sides of the spring-type terminal in the direction perpendicular to the longitudinal direction and the thickness direction of the light emitting part.

According to the above configuration, it is possible to stably keep a contact state between the conductor pattern and the spring-type terminal of the electric connection part and the electrical connection thereof by the compact configuration.

(6) In the illumination apparatus of any of (1) to (5), each of the first and second connectors may be formed with an attaching hole which penetrates in the thickness direction of the light emitting part and in which a screw is inserted.

According to the above configuration, it is possible to easily attach the plurality of illumination units to the attachment body using the screws and to easily detach the plurality of illumination units from the attachment body by unfastening the screws.

(7) In the illumination apparatus of any of (1) to (6), the light emitting parts and the connection part may have a substantially same outer shape in a cross-section perpendicular to the longitudinal direction of the light emitting part.

According to the above configuration, it is possible to easily attach the illumination apparatus to the attachment body and to obtain the illumination apparatus having an excellent design property.

(8) In the illumination apparatus of any of (1) to (7), each of the light emitting parts may include a point light source, and a frame configured to reflect a part of light emitted from the point light source to be emitted from the light emission surface.

According to the above configuration, when the illumination apparatus is attached at a front side (or an inner side) of a lower surface of a shelf plate of a store shelf in a store and the like, it is possible to provide an illumination apparatus which is favorably used as a under shelf illumination apparatus for uniformly illuminating the entirety of the shelf plate one stage below.

According to the above configuration, it is possible to provide an illumination apparatus which can be elongated by connecting a plurality of illumination units and enables each illumination unit to be easily attached and replaced.

BRIEF DESCRIPTION OF THE DRAWINGS

The above and other aspects of the present invention will become more apparent and more readily appreciated from the following description of illustrative embodiments of the present invention taken in conjunction with the attached drawings, in which.

DETAILED DESCRIPTION

Figure 1A:
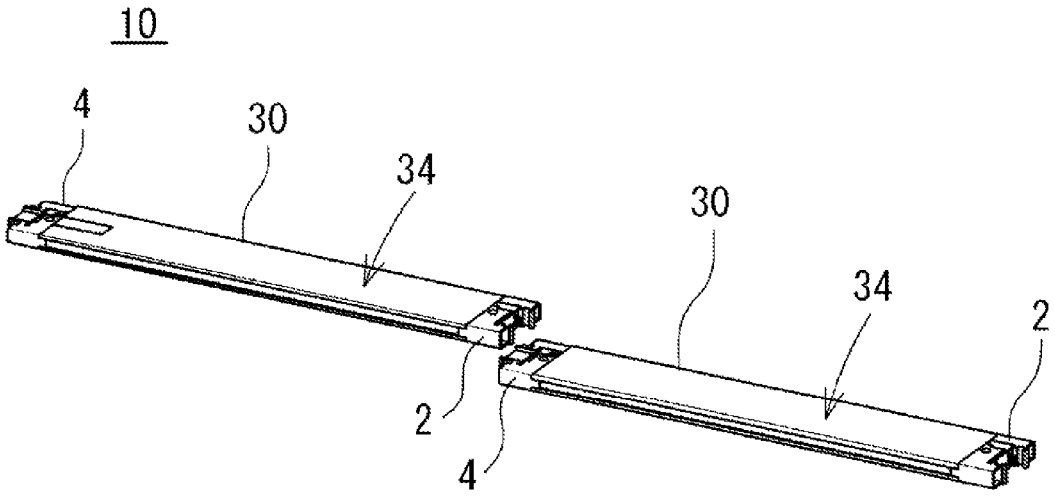
FIG. 1A is an exploded perspective view of a part of an illumination apparatus according to an illustrative embodiment of the present invention as seen from an attachment surface.
Figure 1B:
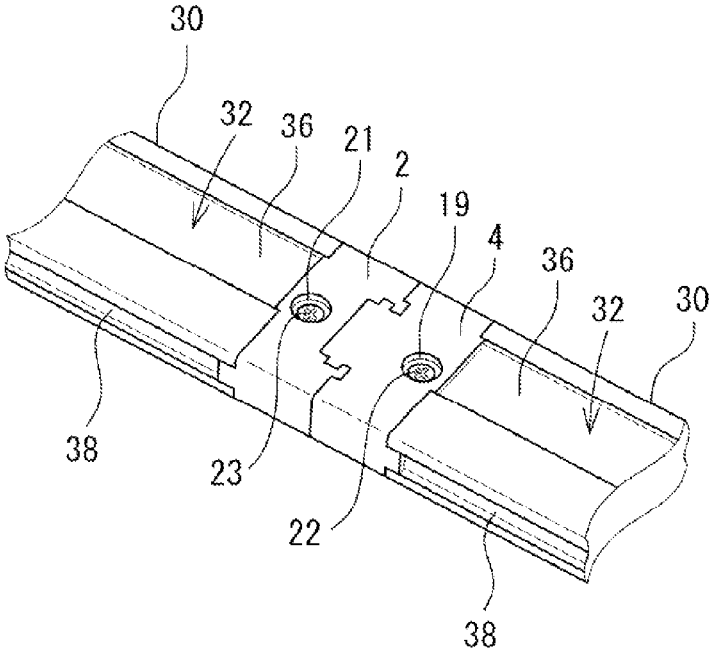
FIG. 1B is a perspective view of a part of the illumination apparatus shown in FIG. 1A as seen from a light emission surface in a state where a first connector and a second connector of one connection part are connected.

Hereinafter, an illustrative embodiment of the present invention will be described with reference to the accompanying drawings. FIG. 1A is an exploded perspective view of a part of an illumination apparatus 10 according to an illustrative embodiment of the present invention as seen from an attachment surface 34, and FIG. 1B is a perspective view of a part of the illumination apparatus 10 shown in FIG. 1A as seen from a light emission surface 32 in a connected state.

The illumination apparatus 10 includes a plurality of light emitting parts 30 and a connection part linearly connecting the plurality of light emitting parts 30. Each light emitting part 30 has a flat cuboidal shape which extends longer in one direction. The plurality of light emitting parts 30 are connected in an extending direction of the light emitting parts 30. Hereinafter, the extending direction of the light emitting part 30 is referred to as a longitudinal direction, a shorter direction of a rectangular cross-section perpendicular to the longitudinal direction is referred to as a thickness direction and a longer direction of the cross-section is referred to as a width direction.

Among six outer surfaces of the cuboid configuring an outer shape of each light emitting part 30, one of two outer surfaces including the longitudinal direction and the width direction is configured as the light emission surface 32 which emits light, and the other (i.e., a facing surface to the light emission surface 32 in the thickness direction of the light emitting part 30) is configured as the attachment surface 34 for attaching the illumination apparatus 10 to an attachment body.

Hereinafter, a direction from the light emission surface 32 towards the attachment surface 34 along the thickness direction of the light emitting part 30 is referred to as an upper direction, and a direction from the attachment surface 34 towards the light emission surface 32 is referred to as a lower direction. It should he noted that the upper and lower directions are defined just for convenience of explanations and do not necessarily coincide with actual upper and lower directions when attaching the illumination apparatus 10.

A first connector 2 is fixed to one end of each light emitting part 30 in the longitudinal direction and a second connector 4 connectable to the first connector 2 is fixed to the other end. The connection part has a pair of connectors 2, 4, i.e., the first connector 2 fixed to one light emitting part 30 and the second connector 4 provided for another light emitting part 30 connected to the one light emitting part 30 and adjacent to the first connector 2 of the one light emitting part 30.

Incidentally, FIG. 1 shows two light emitting parts 30 and one connection part connecting the two light emitting parts 30, as a part of the illumination apparatus 10. It should be noted that in this illustrative embodiment, the illumination apparatus 10 may have the arbitrary number of light emitting parts 30 and the corresponding number of connection parts, as required. For example, when the illumination apparatus 10 has N light emitting parts 30, a total of (N−1) connection parts exist between the respective light emitting parts 30.

In this illustrative embodiment, the light emitting part 30 and the connection part (i.e., the first connector 2 and the second connector 4) have the substantially same rectangular shape, which is an outer shape of a cross-section perpendicular to the longitudinal direction. Accordingly, the illumination apparatus 10 configured by connecting the plurality of light emitting parts 30 through the connection parts becomes a cuboid having the substantially same height except for some necessary recess and prolusion, as shown in FIG. 1B.

Figure 2:
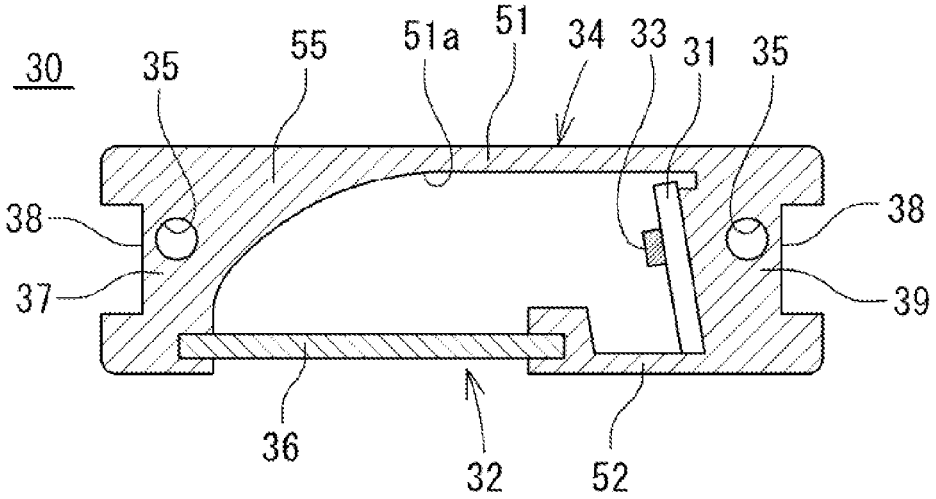
FIG. 2 is a side sectional view of a light emitting part of the illumination apparatus shown in FIG. 1 in a cross-section perpendicular to a longitudinal direction.

As shown in FIG. 2, the light emitting part 30 has a plurality of point light sources 33 and a frame 55 accommodating therein the point light sources 33. In this illustrative embodiment, the point light source 33 is configured by a light emitting diode (LED). The LEDs 33 are linearly mounted on a circuit board 31 in the longitudinal direction (refer to FIG. 4). The circuit board 31 having the LEDs 33 mounted thereon is accommodated in the frame 55.

Specifically, the frame 55 has an upper wall part 51 and a lower wall part 52, which face each other, and two side wall parts 37, 39 connecting the upper wall part 51 and the lower wall part 52 and facing each other. The circuit board 31 is fixed and arranged on one side wall part 39 so that the light from the LED 33 is emitted into a space surrounded by the wall parts 51, 52, 37, 39.

Here, the lower wall part 52 is formed with an emitting opening (a reference numeral is omitted) extending in the longitudinal direction. In the emitting opening, a diffusion plate 36 causing the light emitted from the LED 33 to diffuse and transmit therethrough is arranged. Thereby, a side of the lower wall part 52 of the frame 55, which is one of the outer surfaces of the light emitting part 30, functions as the light emission surface 32 from which the light from the LED 33 is emitted. Also, a side of the upper wall part 51 of the frame 55, which is the attachment surface 34 of the outer surfaces of the light emitting part 30, is configured as a substantially flat surface.

An inner surface 51*a* of the upper wall part 51 has a light reflecting function. A part of the light emitted from the LED 33 is reflected on the inner surface 51*a*, penetrates the diffusion plate 36 and is then emitted to the outside as an illumination light. In order to effectively make light path conversion by the reflection, the inner surface 51*a* of the upper wall part 51 is curved so that a distance between the inner surface 51*a* and the diffusion plate 36 is gradually reduced from a side of the side wall part 39 on which the circuit board 31 is arranged towards the other side wall part 37.

Incidentally, in the illumination apparatus 10, the illumination light emitted to the outside through the light emission surface 32 from the light emitting part 30 also includes a light which is emitted from the LED 33, directly penetrates the diffusion plate 36 without being reflected on the inner surface 51*a* of the upper wall part 51 and is then emitted to the outside as the illumination light.

Further, each of the two side wall parts 37, 39 of the frame 55 is formed with a recess portion 38 extending from one end of the light emitting part 30 in the longitudinal direction to the other end in the vicinity of a center portion of the outer surface thereof in the thickness direction. Also, the two side wall parts 37, 39 are respectively formed with hole portions 35 having predetermined depths along the longitudinal direction from both ends of the light emitting part 30 in the longitudinal direction. The recess portions 38 and the hole portions 35 are used to fix the first and second connectors 2, 4 to the light emitting parts 30 (described later).

Figure 3A:
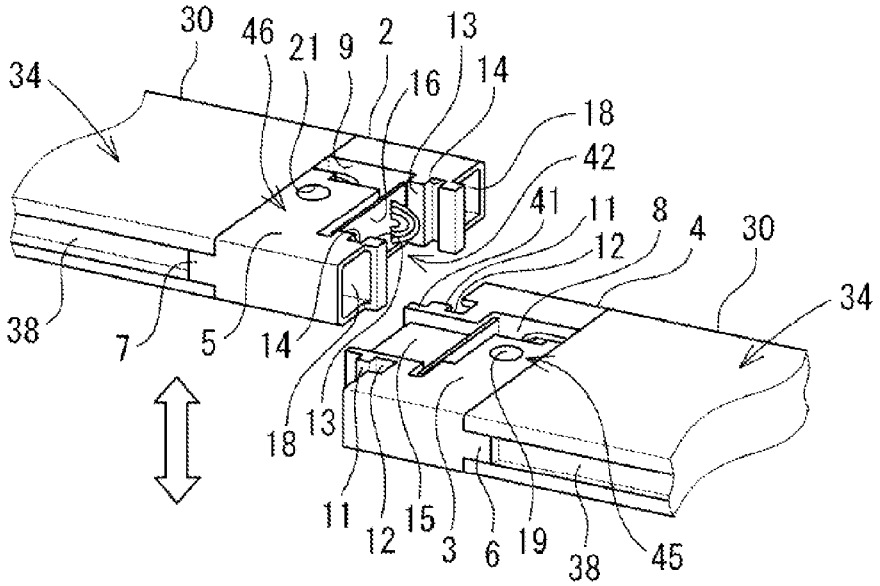
FIG. 3A is an exploded perspective view of the connection part of the illumination apparatus shown in FIG. 1 as seen from the attachment surface.
Figure 3B:
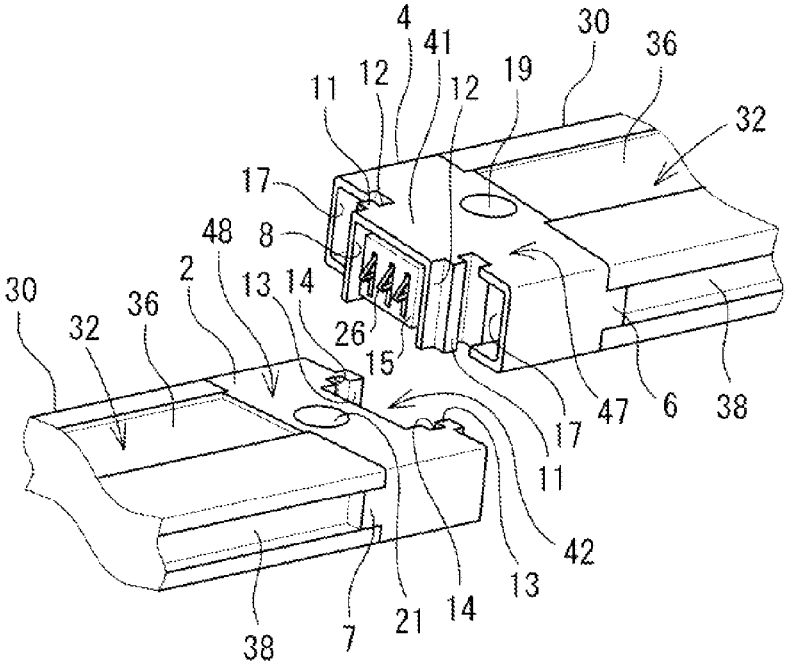
FIG. 3B is an exploded perspective view of the connection part of the illumination apparatus shown in FIG. 1 as seen from the light emission surface.

Subsequently, a configuration of the connection part is described with reference to FIGS. 3A and 3B. FIGS. 3A and 3B are exploded perspective view of the connection part. Specifically, FIG. 3A is a view seen from the attachment surface 34 and FIG. 3B is a view seen from the light emission surface 32.

As shown in FIGS. 3A and 3B, in the illumination apparatus 10, the connection part includes the first connector 2 fixed to one of the two light emitting parts 30 and the second connector 4 fixed to the other light emitting part 30 and facing the first connector 2 fixed to the one light emitting part 30, and also includes a mechanical connection part to be mechanically connected and an electric connection part to be electrically connected when connecting the first connector 2 and the second connector 4.

Hereinafter, a side of the first connector 2 which faces the second connector 4 in the longitudinal direction is referred to as a front and a side thereof fixed to the light emitting part 30 is referred to as a rear. Similarly, a side of the second connector 4 which faces the first connector 2 in the longitudinal direction is referred to as a front and a side thereof fixed to the light emitting part 30 is referred to as a rear. Also, a direction separating away from a center of each of the first and second connectors 2, 4 in the width direction is referred to as an outward direction and a direction facing the center is referred to as an inward direction.

The mechanical connection part of the connection part has concave-convex structures 11, 12, 13, 14 extending in the thickness direction Os shown with a thick arrow in FIG. 3A). The concave-convex structures 11, 12, 13, 14 are configured so that the concave-convex structure 13, 14 of the first connector 2 and the concave-convex structure 11, 12 of the second connector 4 have a complementary structure, as described below.

In the first connector 2, a front part of a main body part 5 becoming a base thereof is provided with an accommodation part 42 recessed rearwards so as to accommodate therein an extension part 41 of the second connector 4 (described later) at a center portion thereof in the width direction. Both inner surfaces 13 of the accommodation part 42 in the width direction are respectively formed with quadrangular concave portions 14 recessed outwardly in the width direction with respect to the inner surfaces 13.

The accommodation part 42 is formed to extend from a surface (hereinafter, referred to as an upper surface) 46 of the first connector 2 at a side of the attachment surface 34 of the light emitting part 30 to a surface (hereinafter, referred to as a lower surface) 48 thereof at a side of the light emission surface 32 of the light emitting part 30 in the thickness direction. The concave portion 14 is also formed to extend from the upper surface 46 to the lower surface 48. The concave portion 14 is formed in the vicinity of the center portion of the accommodation part 42 in the longitudinal direction so that parts of the inner surface 13 remain at the front and rear sides of the concave portion 14.

Meanwhile, in the second connector 4, a front part of a main body part 3 becoming a base thereof is provided with the extension part 41 extending forwards at a center portion thereof in the width direction. Both outer surfaces 12 of the extension part 41 in the width direction are respectively formed with quadrangular convex portions 11 protruding outwardly in the width direction with respect to the outer surfaces 12.

The extension part 41 is formed to extend from a surface (hereinafter, referred to as an upper surface) 45 of the second connector 4 at a side of the attachment surface 34 of the light emitting part 30 to a surface (hereinafter, referred to as a lower surface) 47 thereof at a side of the light emission surface 32 of the light emitting part 30 in the thickness direction. The convex portion 11 is also formed to extend from the upper surface 45 of the second connector 4 to the lower surface 47. The convex portion 11 is formed in the vicinity of the center portion of the extension part 41 in the longitudinal direction so that parts of the outer surface 12 remain at the front and rear sides of the convex portion.

Figure 4:
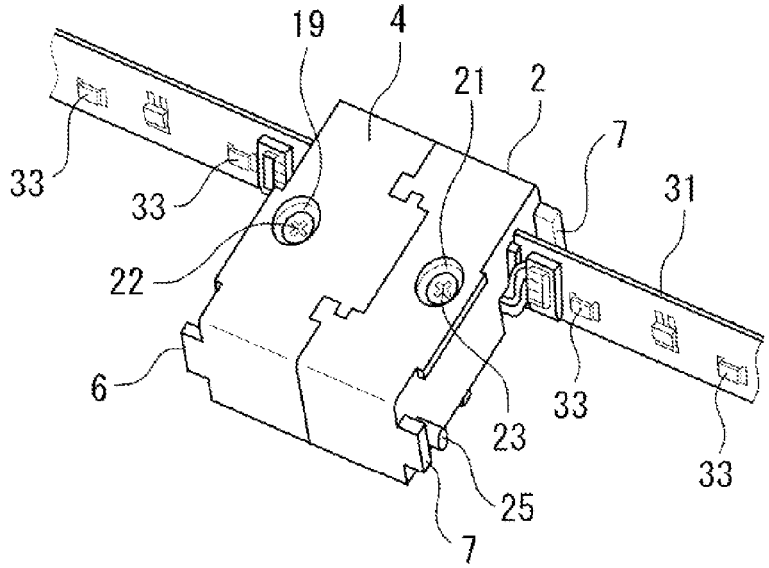
FIG. 4 is a perspective view showing the connection part of the illumination apparatus shown in FIG. 1 in the state where the first connector and the second connector are connected, together with a circuit board on which an LED is mounted.
Figure 5:
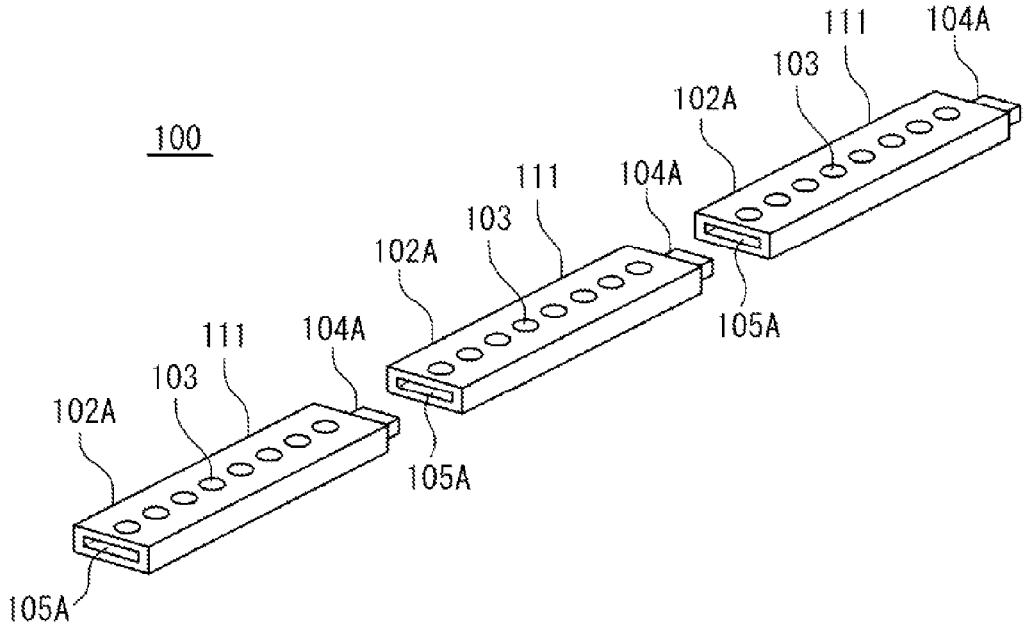
FIG. 5 is an exploded perspective view of an example of a related-art illumination apparatus.

The extension part 41 and the accommodation part 42 are formed so that when connecting the first connector 2 and the second connector 4 each other, both outer surfaces 12 of the extension part 41 respectively abut on the respective inner surfaces 13 of the accommodation part 42 facing the outer surfaces 12, and the convex portions 11 provided on the respective outer surfaces 12 are accommodated in the concave portions 14 provided on the facing inner surfaces 13 without a gap (refer to FIGS. 1B and 4). Accordingly, the concave-convex structures 11, 12, 13, 14 have the complementary structure between the concave-convex structure 13, 14 of the first connector 2 and the concave-convex structure 11, 12 of the second connector 4.

In the concave-convex structures 11, 12, 13, 14, an abutting part between the inner surface 13 at the front of the concave portion 14 and the outer surface 12 at the rear of the convex portion 11, a fitting part between the convex portion 11 protruding outwardly in the width direction than an abutting surface of the abutting part and the concave portion 14, and an abutting part having a abutting surface at position in the width direction same as the above abutting part, between the inner surface 13 at the rear of the concave portion 14 and the outer surface 12 at the front of the convex portion 11 are connected in the longitudinal direction in this order from the front side of the first connector 2, and the respective parts extend in the thickness direction.

In the illumination apparatus 10, the mechanical connection part mechanically connecting the first connector 2 and the second connector 4 is configured by the concave-convex structures 11, 12, 13, 14.

Accordingly, in the illumination apparatus 10, the mechanical connection part is configured by the complementary concave-convex structures 11, 12, 13, 14 extending from the upper surfaces 46, 45 of the first and second connectors 2, 4 to the lower surfaces 48, 47 in the thickness direction. Thereby, when the first connector 2 and the second connector 4 are relatively moved in the thickness direction so that the complementary concave-convex structures 11, 12, 13, 14 are engaged, it is possible to mechanically connect the first connector 2 and the second connector 4.

Also, when releasing the mechanical connection between the first connector 2 and the second connector 4 of the connection part, it is possible to separate the first connector 2 and the second connector 4 by relatively moving the same in the thickness direction.

The main body part 5 of the first connector 2 is formed with a recess portion 9 having a predetermined depth from the upper surface 46 (which does not reach the lower surface 48). The recess portion 9 is formed so that a front end thereof communicates with a rear end of the accommodation part 42, and an element 16 of the electric connection part at a side of the first connector 2 is arranged at the front end of the concave portion 9. Specifically, the element 16 is configured by a circuit board (which is also denoted with the reference numeral 16), and three conductor patterns (not shown) extending in one direction are arranged in parallel on one surface of the circuit board. The circuit board 16 is positioned so that the three conductor patterns face forwards (in other words, so that the surface on which the conductor patterns are formed forms a rear end surface of the accommodation part 42), and is arranged at a front end of the concave portion 9 so that the three conductor patterns extend in the thickness direction and are arranged in parallel in the width direction.

In the meantime, a wiring (a reference numeral thereof is omitted) electrically connecting the circuit board 16 and the light emitting part 30 having the first connector 2 fixed thereto and the like are accommodated at the rear side of the part win which the circuit board 16 of the concave portion 9 is accommodated.

In the meantime, the main body part 3 of the second connector 4 is formed with a concave portion 8 having a predetermined depth from the upper surface 45 (which does not reach the lower surface 47). A part of the concave portion 8 is formed so that a front end is opened in the extension part 41, and an element 15 of the electric connection part at a side of the second connector 4 is arranged at a part of the concave portion 8 formed in the extension part 41. Specifically, the element 15 is configured by an electric connector (which is also denoted with the reference numeral 15), and has three spring-type terminals 26 made of a spring member. The terminals 26 are formed to extend in one direction, are arranged in parallel and are also formed to have elasticity in a direction perpendicular to the extending and arranging directions. The electric connector 15 is arranged in the concave portion 8 so that the terminals 26 face the conductor patterns of the circuit board 16 through the front end opened in the extension part 41, extend in the thickness direction and are arranged in parallel in the width direction.

A wiring (a reference numeral thereof is omitted) electrically connecting the electric connector 15 and the light emitting part 30 having the second connector 4 fixed thereto and the like are accommodated at the rear side of the part in which the electric connector 15 of the concave portion 8 is accommodated.

The accommodation part 42, the circuit board 16, the extension part 41 and the electric connector 15 are configured so that when connecting the first connector 2 and the second connector 4, the three conductor patterns of the circuit board 16 are contacted to the terminals 26 of the electric connector 15 facing the respective conductor patterns. Thereby, the circuit board 16 and the electric connector 15 are electrically connected and the electric connection between the first connector 2 and the second connector 4 is made. At this time, the respective spring-type terminals 26 are configured and arranged to hold the stable contact with the corresponding conductor patterns by forward elastic forces generated due to deformations resulting from the abutting on the conductor patterns.

Accordingly, in the illumination apparatus 10, the electric connection part has the conductor patterns provided on the first connector 2 and the spring-type terminals 26 provided on the second connector 4 and contacting the conductor patterns of the first connector 2, and the conductor patterns and the spring-type terminals 26 are provided to extend in the thickness direction of the light emitting part 30. Thereby, it is possible to electrically connect the first connector 2 and the second connector 4 by the electric connection part and to mechanically connect the same by the mechanical connection part at the same time by relatively moving the first connector 2 and the second connector 4 in the thickness direction.

Here, according to the illumination apparatus 10, the mechanical connection part is respectively provided at both sides of the accommodation part 42 of the first connector 2 and at both sides of the extension part 41 of the second connector 4 in the width direction, as described above. Also, as described above, the electric connector 15 is arranged at the part formed in the extension part 41 of the concave portion 8 of the second connector 4 and the spring-type terminals 26 abut on the conductor patterns on the surface of the circuit board 16, which forms the rear end surface of the accommodation part 42, when connecting the first connector 2 and the second connector 4. Therefore, the mechanical connection part is respectively arranged at both sides of the spring-type terminals 26 in the width direction.

Further, the first connector 2 has a pair of projections 7 having a small piece shape at both ends in the width direction, which protrude rearwards from the main body part 5 in the longitudinal direction. Also, the first connector 2 has a pair of concave portions 18 having a predetermined depth from the front end in the longitudinal direction (without penetrating) at both ends in the width direction (at outer sides of the accommodation part 42 in the width direction). A bottom wall (a wall having an outer surface facing the light emitting part 30) of each of the pair of concave portions 18 is formed with a clearance hole (not shown), in which a screw portion of a screw 25 (refer to FIG. 4) of which a head portion is arranged in the concave portion 18 is inserted, at an inner side of each of the pair of projections 7 in the width direction.

Similarly, the second connector 4 has a pair of projections 6 having a small piece shape at both ends in the width direction, which protrude rearwards from the main body part 3 in the longitudinal direction. Also, the second connector 4 has a pair of concave portions 17 having a predetermined depth from the front end in the longitudinal direction (without penetrating) at both ends in the width direction (at outer sides of the extension part 41 in the width direction). A bottom wall (a wall having an outer surface facing the light emitting part 30) of each of the pair of concave portions 17 is formed with a clearance hole (not shown), in which a screw portion of a screw (although not shown, the screw is denoted with the reference numeral 25, like the screw 25 of the first connector 2 shown in FIG. 4) of which a head portion is arranged in the concave portion 17 is inserted, at an inner side of each of the pair of projections 6 in the width direction.

The first connector 2 is formed with an attaching hole 21 penetrating from the upper surface 46 to the lower surface 48 in the thickness direction, as a counter sinking hole or counter boring hole. A screw 23 (refer to FIGS. 1B and 4) is inserted in the attaching hole 21 from the lower surface 48. Similarly, the second connector 4 is formed with an attaching hole 19 penetrating from the upper surface 45 to the lower surface 47 in the thickness direction, as a counter sinking hole or counter boring hole. A screw 22 (refer to FIGS. 1B and 4) is inserted in the attaching hole 19 from the lower surface 47.

In the illumination apparatus 10, the main body parts 5, 3 of the first connector 2 and second connector 4 are typically made of a white resin, and the frame 55 of the light emitting part 30 is typically made of aluminum.

The operational effects of the illumination apparatus 10 configured as described above are described together with the typical attaching method thereof.

First, the first connector 2 is fixed to one end of the light emitting part 30 in the longitudinal direction and the second connector 4 is fixed to the other end. Then, an illumination unit 30, 2, 4 including the light emitting part 30 and the first connector 2 and second connector 4 fixed to the light emitting part 30 is provided in plural depending on an attachment situation of the illumination apparatus 10.

For example, when fixing the first connector 2 to one end of the light emitting part 30 in the longitudinal direction, the first connector 2 is arranged at the one end of the light emitting part 30 so that a rear end portion of the first connector 2 and the one end of the light emitting part 30 face each other in the longitudinal direction. At this time, the pair of projections 7 of the first connector 2 and the recess portions 38 provided on the outer surfaces of the two side wall parts 37, 39 of the flame 55 are arranged and configured so that the pair of projections 7 is respectively accommodated in the corresponding recess portions 38. Thereby, the first connector 2 is guided to a predetermined position with respect to the light emitting part 30 in the thickness direction and width direction.

The clearance holes formed on the bottom walls of the pair of concave portions 18 of the first connector 2 and the hole portions 35 formed in the two side wall parts 37, 39 of the frame 55 from the one side, to which the first connector 2 is fixed, are arranged so that the concave portions 18 and the hole portions 35 are coaxially aligned at a state where the first connector 2 is arranged at the predetermined position, as described above.

Then, the screw 25 is inserted into the concave portion 18 from the opening side (the front side) of the one concave portion 18, and the screw part of the screw 25 is screwed into the hole portion 35 formed in the one side wall part (for example, the side wall part 39) of the frame 55 through the clearance hole. Similarly, the screw 25 is inserted into the concave portion 18 from the opening (the front end-side) of the other concave portion 18 and the screw part of the screw 25 is screwed into the hole portion 35 formed in the other side wall part (for example, the side wall part 37) of the frame 55 through the clearance hole. Thereby, the first connector 2 is fixed to one end of the light emitting part 30 in the longitudinal direction.

Incidentally, preferably, the hole portions 35 formed in the side wall parts 37, 39 of the frame 55 are simple circular holes, and the screws 25 are screwed with forming a female screw on inner surfaces of the hole portions 35 and are thus fixed by a so-called self-tapping.

Then, the second connector 4 is fixed to the other end of the light emitting part 30 in the longitudinal direction, so that one illumination unit 30, 2, 4 including the light emitting part 30, the first connector 2 and the second connector 4 is configured (for example, refer to FIG. 1A). A length of the one illumination unit 30, 2, 4 is 300 mm, for example. Here, a method of fixing the second connector 4 to the light emitting part 30 is similar to the method of fixing the first connector 2, and the duplicate descriptions are omitted because the first connector 2, the projections 7 and the concave portions 18 of the above descriptions can be read as the second connector 4, the projections 6 and the concave portions 17.

The similar process is repeated using the plurality of light emitting parts 30 and the first and second connectors 2, 4 to be fixed to the respective light emitting parts 30, so that a predetermined number of illumination units 30, 2, 4 are configured.

Here, regarding the assembly of the illumination unit 30, 2, 4, when it is required to electrically connect the circuit board 16 of the first connector 2 and the light emitting part 30 (i.e., the circuit board 31 thereof) and to electrically connect the electric connector 15 of the second connector 4 and the light emitting part 30 (i.e., the circuit board 31), those operations can be performed at any appropriate stage before, during or after the operation of fixing the first and second connectors 2, 4 to the light emitting part 30.

At this time, the first connector 2 having no circuit board 16 may be fixed to the light emitting part 30 and then the circuit board 16 may be arranged at a predetermined position in the concave portion 9 of the first connector 2. Similarly, the second connector 4 having no electric connector 15 may be fixed to the light emitting part 30 and then the electric connector 15 may be arranged at a predetermined position in the concave portion 8 of the second connector 4.

In this sequence, the one illumination unit 30, 2, 4 is first assembled and the assembling sequence is repeated to configure the plurality of illumination units 30, 2, 4. However, in the illumination apparatus 10, as long as a plurality of illumination units 30, 2, 4 are provided, the present invention is not limited to the sequence of fixing the first connectors 2 and the second connectors 4 to the light emitting parts 30.

In the meantime, in the illumination apparatus 10, the pair of projections 7, 6 of the first and second connectors 2, 4 are accommodated in the recess portions 38 of the frame 55 and are engaged by the recess portions 38. This configuration is also advantageous to reduce the relative movements of the first and second connectors 2, 4 to the light emitting part 30 in the width and thickness directions after assembling the illumination unit 30, 2, 4.

Subsequently, a typical sequence of attaching the plurality of illumination units 30, 2, 4 to an attachment body to configure the illumination apparatus 10 is described.

First, the attachment surface 34 of one illumination unit 30, 2, 4 (hereinafter, referred to as a first illumination unit 30, 2, 4) is arranged at a predetermined position of the attachment body, the screws 23, 22 are inserted into the attaching holes 21, 19 of the first connector 2 and the second connector 3 from a side of the light emission surface 32, and the illumination unit 30, 2, 4 is attached to the attachment body by the screws 23, 22.

Then, another illumination unit 30, 2, 4 (hereinafter, referred to as a second illumination unit 30, 2, 4) is connected and attached to the first illumination unit 30, 2, 4 already attached.

For example, when connecting the second illumination unit 30, 2, 4 to the first illumination unit 30, 2, 4 by using the first connector 2 of the first illumination unit 30, 2, 4 and the second connector 4 of the second illumination unit 30, 2, 4 as the connection part, the second illumination unit 30, 2, 4 is arranged with the attachment surface 34 facing the attachment body so that the complementary concave-convex structures 11, 12, 13, 14 of the second connector 4 of the second illumination unit 30, 2, 4 and the first connector 2 of the first illumination unit 30, 2, 4 are engaged. Then, the second illumination unit 30, 2, 4 is moved towards the attachment body in the thickness direction of the light emitting part 30 to mechanically connect the first connector 2 of the first illumination unit 30, 2, 4 and the second connector 4 of the second illumination unit 30, 2, 4 by the mechanical connection part and to electrically connect the same by the electric connection part.

Thereafter, the screws 22, 23 are respectively inserted into the attaching hole 19 of the second connector 4 in this case, the second connector 4 configuring the connection part) of the second illumination unit 30, 2, 4 and the attaching hole 21 of the first connector 2 at the other end of the second illumination unit 30, 2, 4 from the light emission surface 32, so that the second illumination unit 30, 2, 4 is attached to the attachment body by the screws 22, 23.

In the above descriptions, the second illumination unit 30, 2, 4 is connected to the first illumination unit 30, 2, 4 by using the first connector 2 of the first illumination unit 30, 2, 4 and the second connector 4 of the second illumination unit 30, 2, 4 as the connection part. However, the second illumination unit 30, 2, 4 may be connected to the first illumination unit 30, 2, 4 by using the second connector 4 of the first illumination unit 30, 2, 4 and the first connector 2 of the second illumination unit 30, 2, 4 as the connection part.

The above-described sequence is repeated for a desired number of illumination units 30, 2, 4 to configure the illumination apparatus 10 where the plurality of illumination units 30, 2, 4 are connected in the longitudinal direction of the light emitting part 30.

According to the illumination apparatus 10 configured as described above, each of the plural illumination units 30, 2, 4 is attached to the attachment body, so that it is possible to configure the long illumination apparatus 10 where the plurality of illumination units 30, 2, 4 is connected in the longitudinal direction.

At this time, according to the illumination apparatus 10, while one illumination unit 30, 2, 4 is moved in the thickness direction of the light emitting part 30 (i.e., a direction perpendicular to the connecting direction of the illumination unit 30, 2, 4 and also perpendicular to a surface of the attachment body, to which the illumination unit 30, 2, 4 is attached), the one illumination unit 30, 2, 4 can be connected to another illumination unit 30, 2, 4. Therefore, it is possible to easily attach the illumination unit 30, 2, 4 to the attachment body while connecting the same to the illumination unit 30, 2, 4 already attached, thereby improving the operability of attaching the illumination apparatus 10.

Also, during the attaching operation of the illumination apparatus 10 of after completing the illumination apparatus 10, when detaching a specific illumination unit 30, 2, 4, it is possible to easily detach the specific illumination unit 30, 2, 4 without influencing the attached state of other illumination units 30, 2, 4 by removing the screws 22, 23 and then moving the specific illumination unit 30, 2, 4 in the thickness direction of the light emitting part 30.

Further, according to the illumination apparatus 10, when attaching a new illumination unit 30, 2, 4 between the two illumination units 30, 2, 4 already attached, it is possible to easily attach the new illumination unit 30, 2, 4 without influencing the attached states of the two illumination units 30, 2, 4 already attached by configuring the first connector 2 of the one illumination unit 30, 2, 4 already attached, the second connector 4 of the other illumination unit 30, 2, 4 and the second connector 4 and first connector 2 of the new illumination unit 30, 2, 4, as the connection part, and moving the new illumination unit 30, 2, 4 towards the attachment body in the thickness direction.

Therefore, according to the illumination apparatus 10, during the attaching operation of the illumination apparatus 10 or after completing the attaching operation of the illumination apparatus 10, when it is necessary to replace a specific illumination unit 30, 2, 4 due to the breakage of the illumination unit 30, 2, 4 and the like, it is possible to easily replace the illumination unit 30, 2, 4.

According to the illumination apparatus 10, the connection part has the mechanical connection part, which extends in the thickness direction of the light emitting part 30, and in which the first connector 2 and the second connector 4 have the complementary concave-convex structures 11, 12, 13, 14, and the electric connection part which has the conductor patterns provided on the first connector 2 and extending in the thickness direction of the light emitting part 30 and the spring-type terminals 26 provided on the second connector 4 to contact the conductor patterns of the first connector 2 and extending in the thickness direction of the light emitting part 30. Thereby, it is possible to connect the illumination units 30, 2, 4 in the longitudinal direction by moving the illumination unit in the thickness direction of the light emitting part 30 through the simple and low-cost configuration.

At this time, according to the illumination apparatus 10, the concave-convex structures 11, 12, 13, 14 configuring the mechanical connection part can effectively restrain the relative movement between the first connector 2 and the second connector 4 of the connection part in the longitudinal direction since the concave-convex structures 11, 12, 13, 14 extending in the thickness direction are formed in the longitudinal direction of the light emitting part 30. Also, since the concave-convex structures 11, 12, 13, 14 are provided at a plurality of positions (in the above-described illustrative embodiment, two positions of both sides of the accommodation part 42 and the extension part 41 in the width direction) in the width direction of the light emitting part 30, it is possible to effectively restrain the relative movement between the first connector 2 and the second connector 4 of the connection part in the width direction of the light emitting part 30.

Further, since the concave-convex structures 11, 12, 13, 14 of the mechanical connection part of the illumination apparatus 10 are respectively arranged at both sides of the accommodation part 42 and the extension part 41 in the width direction, i.e., at both sides of the spring-type terminals 26 of the electric connector 15 in the width direction, it is possible to stably keep the contact state between the conductor patterns on the circuit board 16 of the electric connection part and the terminals 26 of the electric connector 15 by the compact configuration.

In particular, according to the illumination apparatus 10, the concave-convex structures 11, 12, 13, 14 at both sides of the terminals 26 are line-symmetrically configured with respect to a center line of the light emitting part 30 in the width direction, which center line serves as a symmetrical axis, when seen from a plan view. This configuration is advantageous to restrain the relative movement between the first connector 2 and the second connector 4 in the width direction of the light emitting part 30 in a balanced manner and to stably keep the contact state with the terminals 26 of the electric connector 15.

Also, the illumination apparatus 10 is configured so that the light emitting part 30 and the connection part (i.e., the first connector 2 and the second connector 4) have the substantially same rectangular shape, which is an outer shape of a cross-section perpendicular to the longitudinal direction. Thereby, since the illumination apparatus 10 configured by connecting the plurality of illumination units 30, 2, 4 becomes the cuboid having the substantially same height except for some necessary recess and protrusion, it is possible to easily attach the illumination apparatus 10 to the attachment body and to implement an illumination apparatus having an excellent design property.

Incidentally, the present invention is not limited by the utilities of the illumination apparatus 10. However, the illumination apparatus 10 having the light emitting part 30 including the LEDs 33 and the frame 55 illuminates a surface to be illuminated located at a side of the light emission surface 32 over a wide range from just below the light emission surface 32 to the front (a direction from the side wall part 39 of the frame 55 on which the circuit board 31 is arranged towards the side wall part 37 facing thereto) of the illumination apparatus 10. Therefore, for example, when the illumination apparatus 10 is attached at a front side (or an inner side) of a lower surface of a shelf plate of a store shelf so that a direction facing from the front side towards the inner side (or a direction facing from the inner side towards the front side) becomes the front of the illumination apparatus 10, it is possible to favorably use the illumination apparatus 10 as a under shelf illumination apparatus for uniformly illuminating the entirety of the shelf plate one stage below.

At this time, when each of the plural illumination units 30, 2, 4 is attached to the shelf plate, which is the attachment body, it is possible to configure the long illumination apparatus 10 where the plurality of illumination units 30, 2, 4 are connected in the longitudinal direction. Also, it is possible to easily attach, detach and replace the illumination unit 30, 2, 4 by moving the illumination unit 30, 2, 4 in the thickness direction of the light emitting part 30 (i.e., in this case, a direction perpendicular to the lower surface of the shelf plate, which is the attachment surface). The illumination apparatus 10 having the above-explained features is particularly advantageous to improve the operability of attaching and replacing the under shelf illumination apparatus.

Meanwhile, according to the illumination apparatus 10, the mechanical connection part is configured so that when connecting the first connector 2 and the second connector 4, the outer surfaces 12 of both sides of the extension part 41 and the inner surfaces 13 of the accommodation part 42 facing the outer surfaces 12 abut on each other and the convex portions 11 provided on the outer surfaces 12 are accommodated in the concave portions 14 provided on the facing inner surfaces 13 without a gap.

However, according to the illumination apparatus of the present invention, the mechanical connection part may include a part where the constitutional elements face with a predetermined gap as long as the relative movement between the first connector 2 and the second connector 4 is effectively restrained in the longitudinal direction and the width direction. In the present invention, the concave-convex structures 11, 12, 13, 14 having this configuration are also referred to as complementary.

Further, regarding the concave-convex structures 11, 12, 13, 14 formed in the longitudinal direction, the concave portions 14 formed on the inner surfaces 13 of the accommodation part 42 and the convex portions 11 formed on the outer surfaces 12 of the extension part 41 are provided in the vicinity of the center portions of the accommodation part 42 and the extension part 41 in the longitudinal direction so that the parts of the inner surfaces 13 and the outer surfaces 12 remain at the front and rear sides of the concave portions and the convex portions. However, the concave portions 14 may be formed at positions at which the parts of the inner surfaces 13 remain at least in front of the convex portions 13 (in correspondence to this, the convex portions 11 may be formed at positions at which the parts of the outer surfaces 12 remain at least at the rear of the convex portions 13), regarding the restraint of the relative movement between the first connector 2 and the second connector 4 in the longitudinal direction.

Also, since the illumination units 30, 2, 4 are not connected to both ends of the illumination apparatus 10 in the entire longitudinal direction thereof, a connector different from the first and second connectors 2, 4 may be fixed. For example, a connector for receiving power from the outside may be fixed to one end of the illumination apparatus 10 in the entire longitudinal direction and a connector for short or a connector for closing an opening may be fixed to the other end.

Also, the illumination unit 30, 2, 4 may be attached to the attachment body by an arbitrary fixing tool, rather than the screws 22, 23.

What is claimed is:

1. An illumination apparatus comprising:

a plurality of light emitting parts, each of the light emitting parts having a shape extending in a longitudinal direction, a thickness direction, and a width direction, with each of the directions being perpendicular to one another; and a connection part linearly connecting the plurality of light emitting parts, wherein each of the light emitting parts includes:

a first face extending in the longitudinal direction and the width direction and includes a light emission surface configured to emit light; and a second face extending in the longitudinal direction and the width direction and facing the first face in the thickness direction, the second face including an attachment surface, and wherein the connection part includes:

a first connector fixed to one end of one of the light emitting parts in the longitudinal direction thereof;

a second connector fixed to the other end of an adjacent one of the light emitting parts in the longitudinal direction and connected to the first connector of the one of the light emitting parts; and a mechanical connection part and an electric connection part of mechanically and electrically connecting the first connector of the one of the light emitting parts and the second connector of the adjacent one of the light emitting parts by relatively moving the first connector and the second connector in the thickness direction of the light emitting part.

2. The illumination apparatus according to claim 1, wherein the mechanical connection part has a concave-convex structure extending in the thickness direction of the light emitting part, and wherein in the concave-convex structure, a structure of the first connector and a structure of the second connector are complementary to each other.

3. The illumination apparatus according to claim 1, wherein the electric connection part includes:

a conductor pattern provided on the first connector; and a spring-type terminal provided on the second connector and configured to contact the conductor pattern, and wherein the conductor pattern and the spring-type terminal are provided to extend in the thickness direction of the light emitting part.

4. The illumination apparatus according to claim 3, wherein the concave-convex structure is formed along the longitudinal direction of the light emitting part and is provided at a plurality of positions in a direction perpendicular to the longitudinal direction and the thickness direction of the light emitting part.

5. The illumination apparatus according to claim 4, wherein the concave-convex structure is provided at both sides of the spring-type terminal in the direction perpendicular to the longitudinal direction and the thickness direction of the light emitting part.

6. The illumination apparatus according to claim 1, wherein each of the first and second connectors is formed with an attaching hole which penetrates in the thickness direction of the light emitting part and in which a screw is inserted.

7. The illumination apparatus according to claim 1, wherein the light emitting parts and the connection part have a substantially same outer shape in a cross-section perpendicular to the longitudinal direction of the light emitting part.

8. The illumination apparatus according to claim 1, wherein each of the light emitting parts includes:

a point light source; and a frame configured to reflect a part of light emitted from the point light source to be emitted from the light emission surface.

* * * * *